United States Patent [19]

Taddeo

[11] 4,187,864

[45] Feb. 12, 1980

[54] CIGARETTE HOLDER FOR ASH RECEPTACLES

[76] Inventor: Michael Taddeo, 35-07 205th St., Bayside, N.Y. 11361

[21] Appl. No.: 833,090

[22] Filed: Sep. 14, 1977

[51] Int. Cl.[2] ..... A24F 19/00

[52] U.S. Cl. ..... 131/242; 131/257; 220/1 H

[58] Field of Search ..... 131/240, 241, 242, 257, 131/240 GG, 231, 238; 220/1 H, 1 BC

[56] References Cited

U.S. PATENT DOCUMENTS

| | | | |
|---|---|---|---|
| 2,158,770 | 5/1939 | Bartlett | 131/257 X |
| 2,880,736 | 4/1959 | Lockholder | 220/1 H X |
| 3,364,937 | 1/1968 | D'Amaro | 131/257 |
| 3,620,225 | 11/1971 | Bailey | 220/1 H X |

*Primary Examiner*—Stephen C. Pellegrino
*Attorney, Agent, or Firm*—Robert D. Farkas

[57] ABSTRACT

A cigarette holder for ash receptacles utilizes a cap adapted for attachment to the top of an opened beverage container having a circumferential side wall joined to a plate. The plate includes an elongated opening configured to reside over an opening in the top of the beverage can. A block is secured to the cap having an inclined surface extending downwardly towards the center of the plate and directed towards one end of the opening. A groove is provided for resting cigarettes thereupon. A rim extends upwardly from the plate so as to prevent accidental usage of the can as a food receptacle after the can has been utilized as an ash receiver. Rotating the cap causes the opening in the plate to reside at another location other than above the opening in the top of the can. A small passageway couples the uppermost surface of the plate to the lowermost surface of the wall so as to allow water or other liquids contained in the can to drip along the side of the can in the event a user attempts to drink from the ash containing can.

4 Claims, 3 Drawing Figures

CIGARETTE HOLDER FOR ASH RECEPTACLES

BACKGROUND OF THE INVENTION

1. The Field of the Invention

This invention relates to cigarette holders and more particularly to that class of holder adapted for removable attachment to beverage containers.

2. Description of the Prior Art

The prior art abounds with cigarette holders whose utility involves the use of separable ash receivers. U.S. Pat. No. 3,777,767 issued on Dec. 11, 1973, to W. K. Wunsch teaches an attachment for cylindrical containers, such as coffee cans, comprising an elongated member having a main body portion and an extension of reduced cross section. The body portion has walls flaring downwardly from its top or ridge and attaching means near its end opposite the handle for frictional engagement with the top of the container; the handle is of reduced section extending from the ridge and arranged to rest on the top edges of containers of differing diameters within a predetermined range of diameters so that the body portion may be supported for use in a range of sizes of containers. Recesses for holding cigarettes horizontally across the container are arranged at spaced intervals along the ridge of the main body.

U.S. Pat. No. 2,991,789 issued on July 11, 1961, to H. E. Smith et al discloses a cigarette holder, also for attachment to the top of a beverage container. A flat sheet is provided having a plurality of bends therein such that the centermost bent portion of the sheet provides cavities in which portions of cigarettes may reside in a resting position. A pair of locks are slidably affixed adjacent the ends of the sheet, having permanent magnets affixed to the lowermost regions thereof. In use, the Smith device is installed having the permanent magnets contacting the rim of the metallic container and having the cigarette receiving cavities or notches disposed over the surface of the steel-like beverage container having an open top.

U.S. Pat. No. 2,158,770 issued on May 16, 1939, to H. D. Bartlett describes a conversion unit fabricated from a thin sheet disposed in a horizontal position having an upwardly extending arm to which is affixed a fluted circular skirt. The center region of the skirt is provided with an opening. A beverage container, such as a beer can, may be installed residing on the uppermost lateral surface of the lower sheet portions and having its open top positioned below the opening in the fluted skirt portion. The skirt acts as a cigarette holding device and somewhat as a funnel so that ashes collected thereon tend to roll downwardly to the opening of the beverage container.

All of the afore mentioned devices suffer a variety of deficiencies. None of them permit the top of the container to be closed after being used as a cigarette ash receiver. Furthermore, each beverage container, when removed from the inventive disclosures, may be reused as a beverage container since the entire uppermost surface of the container is not totally enclosed in a cap. Misalignment of cigarette holding grooves to the opening in the top of the beverage container is also a disadvantage.

SUMMARY OF THE INVENTION

A primary object of the present invention is to provide a cigarette holder for beverage containers in which the cigarette and its ashes are caused to reside within the container as opposed to portions of the lid thereof.

Another object of the present invention is to provide a seal for a beverage container when the apparatus is not being utilized as an ashtray.

Still another object of the present invention is to provide an inexpensive apparatus which is safe against unwarranted use by children or others when attempting to drink from a beverage container previously utilized as an ash receiver.

Heretofore, ash receivers utilizing beverage containers failed to provide an apparatus which permitted a container to be sealed after the container and apparatus was employed supporting and collecting ashes from cigarettes. Attachment of the apparatus to the upper regions of a metallic beverage container was difficult and ill-suited for containers having only an elongated pouring spout therein. The present invention not only overcomes these problems but provides a drain path through which collected liquids, stored within the container, may drip along the surface of the beverage container when the container is tilted as in a drinking position. Closing the pouring spout of the container is accomplished by a simple rotational force applied to the apparatus relative to the exterior surface of the container. Because of the the waterproof nature of the beverage container and its geometry, lit cigarettes placed therein tend to be rapidly extinguished due to the lack of oxygen and avoid the problem in which smoke continues to exit from the container after a lit cigarette is dropped therein. The container is also maintained at a relatively low temperature due to the presence of some water or other liquid in the regions thereof. Installation of the cap assembly is made simple by virtue of the construction of the present invention.

DESCRIPTION OF THE PREFERRED EMBODIMENT

The structure and method of fabrication of the present invention is applicable to a unitary apparatus comprising a cylindrical tube having a plate fixedly secured thereto and extending transverse to the longitudinal axis of the tube. The uppermost surface of the plate resides intermediate the open end of the tube. The marginal edges adjacent the uppermost end of the tube are contoured so as to provide in one area an edged surface which extends upwardly from adjacent regions of the same marginal edge. The plate is provided with an elongated wedge-like opening, having its widest regions disposed adjacent to the portion of the edge of the tube extending above the remaining portions of the edge of the tube. A wedge-shaped block is disposed on the same marginal edge of the tube having its thinnest section disposed adjacent to and contiguous with the narrowmost end of the tapered opening. An elongated groove is disposed along the ramp surface of the wedge-shaped block such that the groove extends radially outwardly from the center of the tube. A passageway is located within the wall of the tube having one open end thereof residing adjacent to the widest end of the opening in the plate. The other opening of the passageway is disposed residing on the lowermost marginal edge of the tube.

In use, the apparatus is installed onto a beverage container having an opening in the lid thereof by having the lowermost marginal edge of the tube disposed along side the exterior surface of the container. The tube or cap apparatus may be rotated such that the opening in the plate may be caused to correspond with and be juxtaposed with the opening in the top of the beverage container. A small amount of water, or other liquid, may be stored in the base of the container facilitating extinguishing of lit cigarettes dropped through the aligned openings in the plate of the present invention and the top of the beverage container. The cap may be rotated so as to close off the opening in the top of the beverage container. Cigarettes may be disposed having their lit end partially residing in the opening in the plate if desired. When an infant or other individual attempts to drink from the beverage container liquids stored therewithin enters the passageway adjacent the open mouth region of the container and passes outwardly therefrom through the lowermost opening of the passageway so as to drip or run down the sides of the exterior surface of the container serving as a warning that the container should not be utilized for drinking purposes. The entire apparatus may be unitary in nature and fabricated from a plastic-like material such as a molding of phenol type materials. If desired, however, the apparatus may be constructed of a lightweight metal, such as aluminum.

Figure 1:
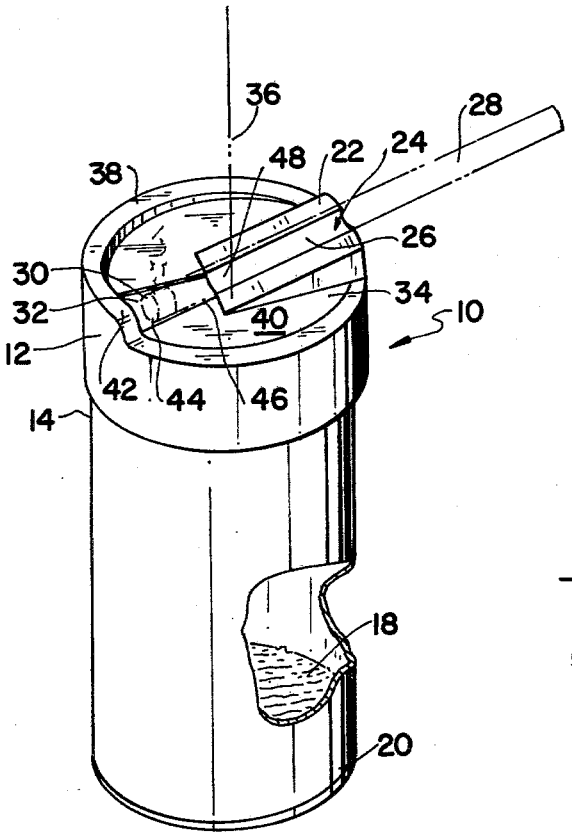
FIG. 1 is perspective view of the present invention shown installed on a cylindrical beverage container.

Now referring to the figures and more particularly to the embodiment illustrated in FIG. 1 showing the present invention 10 having a cylindrical tube 12 secured to the uppermost regions 14 of a cylindrical can 16 herebefore serving as a beverage container. A small amount of water or other liquid 18 is disposed in the lowermost regions 20 of the container. A ramp like surface 22 is shown provided with an elongated groove 24 in which portions 26 of cigarette 28 are rested. Lit end 30 of cigarette 28 is shown residing in an elongated wedge-like opening 32 disposed within plate 34 located extending transverse to the longitudinal axis 36 of tube 12. Surface 22 is shown extending in part over uppermost marginal edge 38 of tube 12. Marginal edge 38 is shown to extend above the uppermost lateral surface 40 of plate 34, especially in the vicinity of region 42 adjacent opening 32. Opening 32 is shown having a wider portion 44 adjacent to tube 12 than portion 46 shown disposed adjacent to end 48 of groove 24. Enlongated opening 32 has the longitudinal axis of groove 24.

Figure 2:
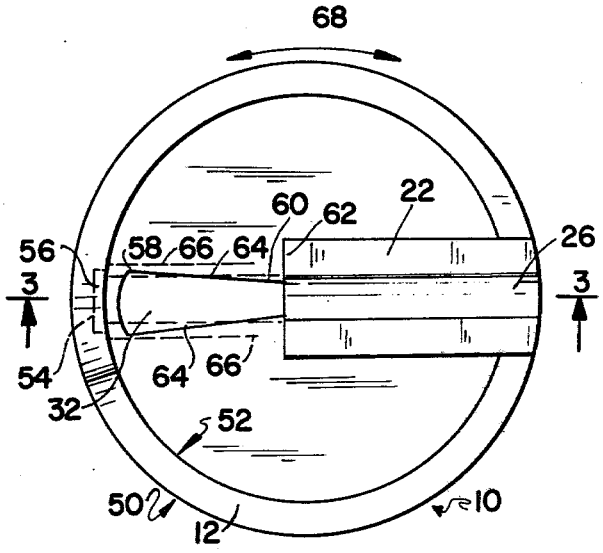
FIG. 2 is a plan view of the present invention.

FIG. 2 illustrates tube 12 having an outermost cylindrical surface 50 and an innermost cylindrical surface 52. Dotted lines 54 denote passageway 56 disposed communicating with surface 52, adjacent the widest portions 58 of opening 32. Narrowest portions 60, of opening 32 is disposed adjacent end 62 of surface 22 and groove 26 in surface 22. Dotted lines 64 and 66 depict an opening located in the top of container 16, as shown in FIG. 1, when the apparatus is rotated in the direction of arrows 68 so as to be juxtaposed. Rotating present invention 10 in the direction of arrows 68 permits opening 32 to be located at another position, other than directly over the opening in the container there below.

Figure 3:
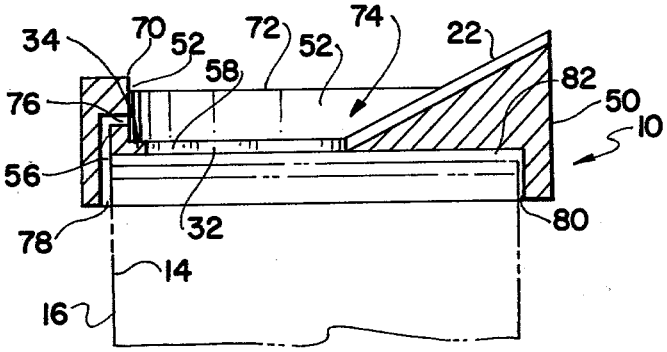
FIG. 3 is a side elevational cross sectional view taken along line 3—3, as viewed in the direction of arrow 3—3, of the apparatus shown in FIG. 2.

FIG. 3 illustrates the present invention 10 wherein the uppermost lateral surface 22 is shown extending outwardly to surface 50. Cylindrical surface 52 is shown having a portion 70 thereof extending upwardly from the uppermost marginal edge 72 of the remaining areas of the tube. This prohibits convenient drinking out of container 16 by having liquid pass through opening 32 into openmouth cavity 74 formed by cylindrical surface 52. Passageway 56 is shown having end 76 disposed within cavity 74 adjacent end 58 of opening 32. End 78 of passageway 56 is shown adjacent end 14 of container 16. Opening 80 is shown below plate 34 and is provided having a cylindrical shape facilitating the insertion of rim 82 of container 16.

One of the advantages of the present invention is to provide a cigarette holder for beverage containers in which the cigarette and its ashes are caused to reside within the container as opposed to portions of the lid thereof.

Another advantage of the present invention is to provide a seal for a beverage container when the apparatus is not being utilized as an ashtray.

Still another advantage of the present invention is to provide an inexpensive apparatus which is safe against unwarranted use by children or others when attempting to drink from a beverage container previously utilized as an ash receiver.

Thus there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows.

I claim:

1. A cigarette holder for ash receptacles comprising a cylindrical tube, said cylindrical tube having an interior surface and upper and lower marginal edges, a plate, said plate having an upper lateral surface and a lower lateral surface, said plate being disposed fixedly secured to said interior surface of said tube at a location intermediate said upper and said lower marginal edges and extending substantially perpendicularly to the longitudinal axis to said tube, said tube having a passageway, said passageway having one end thereof located in said interior surface and intermediate said upper marginal edge and said upper lateral surface of said plate, the other end of said passageway located in said lower marginal surface of said tube, said plate having an opening therein, one end of said opening being disposed adjacent said one end of said passageway, said plate having a ramped surface, said ramped surface extending upwardly and outwardly from said upper lateral surface of said plate, said ramped surface having an elongated groove therein, said elongated groove having one end thereof disposed the other end of said opening, said opening having an elongated shape.

2. The apparatus as claimed in claim 1 wherein said tube and said plate comprise a unitary construction.

3. The apparatus as claimed in claim 1 wherein one end of said ramped surface intersects said upper lateral surface of said plate.

4. The apparatus as claimed in claim 1 further comprises said tube having said upper marginal edge including a projection on a portion of said upper marginal edge extending in the direction of said longitudinal axis and upwardly from an adjacent portion of said upper marginal edge of said tube, said projection being disposed adjacent said one end of said opening.

* * * * *